US005324244A

United States Patent [19]

Miller et al.

[11] Patent Number: 5,324,244

[45] Date of Patent: Jun. 28, 1994

[54] WRIST ASSIST DEVICE FOR WEIGHTLIFTING

[76] Inventors: Charles L. Miller, 1807 Stardust Dr.; James C. Schultz, 2400 Parklawn Dr. - #210, both of Waukesha, Wis. 53186

[21] Appl. No.: 897,898

[22] Filed: Jun. 12, 1992

[51] Int. Cl.[5] ..... A63B 21/072

[52] U.S. Cl. ..... 462/106; 602/64; 602/21

[58] Field of Search ..... 482/106, 50, 105; 2/161 A, 16, 162; 602/64; 128/165, 169

[56] References Cited

U.S. PATENT DOCUMENTS

| | | | |
|---|---|---|---|
| 680,477 | 8/1901 | Drosness | 602/64 |
| 923,217 | 6/1909 | Tyrrell | 602/64 |
| 1,408,919 | 3/1922 | Wilson | 602/64 |
| 2,651,776 | 9/1953 | Beatty | 2/16 |
| 3,536,068 | 10/1970 | Stubbs | 602/64 X |
| 4,348,774 | 9/1982 | Woodson . | |
| 4,487,412 | 12/1984 | Meeko | 482/106 X |
| 4,602,784 | 7/1986 | Budden et al. | 482/105 |
| 4,685,668 | 8/1987 | Newlin, Jr. . | |
| 4,782,535 | 11/1988 | Yewer, Jr. et al. . | |
| 5,004,231 | 4/1991 | Alread | 482/106 X |

FOREIGN PATENT DOCUMENTS

| | | | |
|---|---|---|---|
| 1270602 | 6/1990 | Canada | 2/16 |

*Primary Examiner*—Richard J. Apley
*Assistant Examiner*—Beverly A. Meindl
*Attorney, Agent, or Firm*—Ryan, Kees & Hohenfeldt

[57] ABSTRACT

An improved weightlifting assist device is provided that includes a flexible fabric strap and a ring attached to a protective cushioning member or layer. The strap is attached to the cushioning member by stitching the strap to a point on the cushioning member between the ends of the cushioning member. The strap has its opposite end unattached so that it can be threaded through the ring and folded flat against the palm of the user. The free end of the strap can then be wrapped around a weightbars to assist in transferring of a weight to the forearm of a weightlifter, relieving the lifter's fingers of the majority of the load. The cushioning layer may be substantially wider than the fabric strap, so as to distribute the forces of the weightlifting activity over a larger area, reducing irritation that would be caused by the strap alone.

17 Claims, 1 Drawing Sheet

WRIST ASSIST DEVICE FOR WEIGHTLIFTING

BACKGROUND OF THE INVENTION

The present invention relates to devices for assisting weightlifters. More specifically, the invention relates to wrist straps for transfer of forces developed during weightlifting from the weightlifter's fingers to his wrist and forearm, that is, from the muscles of his forearm to those of his upper arm and torso.

Weightlifting straps have heretofore been employed, generally in the form of nylon, canvas or similar heavy fabric straps in which one end is sewn back on itself to form a loop. Such a strap is wrapped around the weightlifter's wrist, and the opposite end inserted through the loop and then wrapped around a weight bar that has weights attached to its opposite ends. The weightlifter keeps the strap in place around the weight bar by means of application of a moderate squeezing force provided by the fingers. The strap then transfers the bulk of the weight to the weightlifter's upper arms and torso. However, due to the twisting of the strap required to pass through the loop, the strap tends to cut into or squeeze and abrade the user's wrist. Additionally, the edge of the strap can dig into the base of the user's palm where it can also cause abrasion and blistering, A need has therefore existed for improved weightlifting straps.

This invention relates to improvements to the apparatus described above and to solutions to some of the problems raised or not solved thereby,

SUMMARY OF THE INVENTION

An object of the invention is to provide an improved heavy duty durable weightlifting strap. A related object is to provide such a strap which gives a weightlifter uniform wrist support of a weight bar while avoiding pulling the hands or the wrist joints.

An important aspect of the invention is to provide a wrist strap having a cushioning wrist circling portion wider than, or possibly at least as wide as, a conventional weight bar encircling strap. A further aspect of the invention is the use of a heavy duty ring, separated from the wrist by the cushioning portion, to enable folding of the strap with a 90° bend while still lying flat against the user's wrist and palm. Another aspect is the use of a laminated wide cushioning portion that is durable, yet of a visually attractive appearance.

Briefly summarized, the invention includes a flexible fabric strap and a heavy ring, the ring having a diameter at least as great as the width of the strap. The strap is secured at one end to a protective cushioning layer having a width which may be greater than that of the strap and of the ring. The cushioning layer preferably is formed from a composite that includes a core of cushioning foam material having, on each side, an elastic fabric surface layer.

Other objects and advantages of the invention will become apparent hereinafter.

DESCRIPTION OF THE PREFERRED EMBODIMENTS

Figure 1:
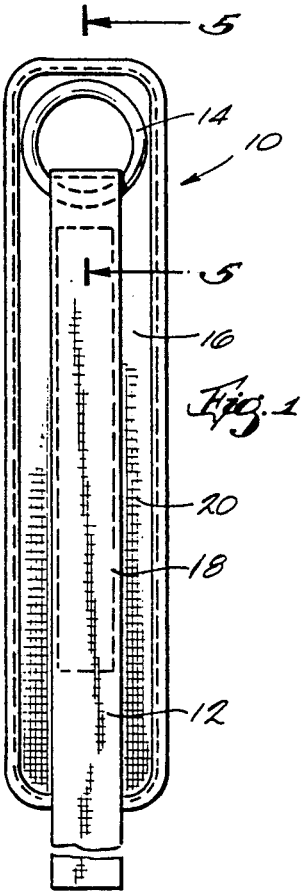
FIG. 1 is a top plan view of a weightlifting strap constructed according to one embodiment of the present invention.

Referring first to FIG. 1, a weightlifting device 10 constructed according to one embodiment of the present invention includes a strap portion 12 formed of a flexible fabric such as woven nylon. A folding means 14 is attached to one end of strap 12 and has a central opening at least as great as the width of strap. In this embodiment the attachment of the folding means 14 is preferably by inserting the strap 12 through the central opening, folding the strap and stitching it to itself. Attached to that end of strap 12 is a wider protective member or layer 16 that extends beyond the free end of folding means 14. Each end of protective layer 16 has an end segment that is not attached by stitching to strap 12 so that the ends of the strap and the ends of the protective layer can be separated from the strap. Strap 12 and protective layer 16 are preferably secured to each other by stitching 18. The folding means 14 is preferably formed of a hard material such as a durable metal or plastic composite, and may be of several suitable closed shapes with central openings, such as triangular, rectangular or D-shaped, the most preferable shape being annular or round as the ring 14 shown in the drawing figures.

Alternatively, the ring 14 could be attached directly to the protective layer 16, nearer one end thereof. Strap 12, already disclosed to be attached to the protective layer 16, could then be attached just to the end of layer 16 opposite where the ring 14 is attached, and extend beyond that end.

Figure 2:
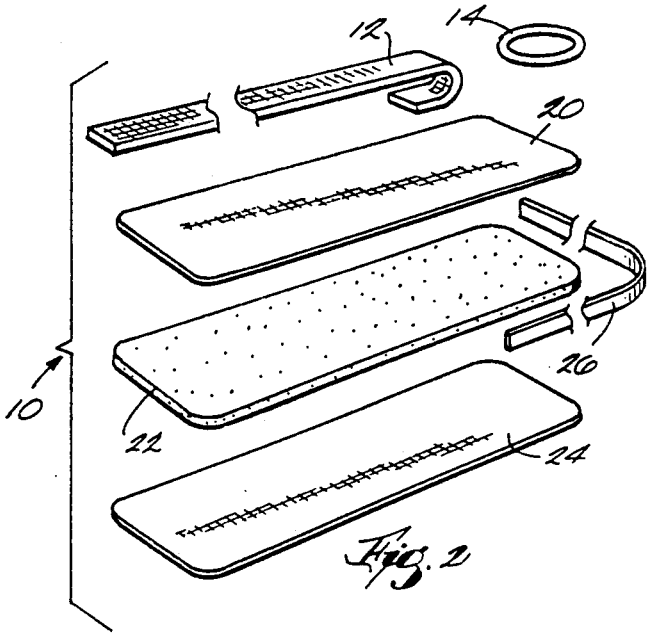
FIG. 2 is an exploded perspective view of the device shown in FIG. 1.
Figure 5:
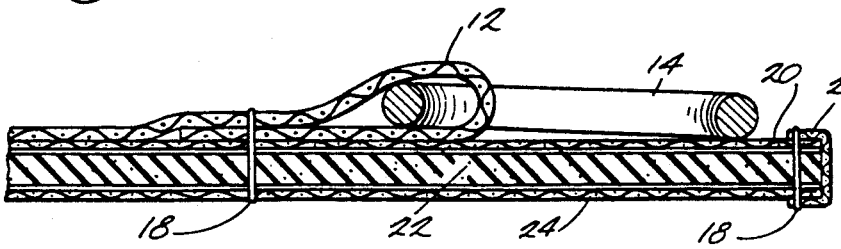
FIG. 5 is a cross-sectional view, taken generally along line 5—5 of FIG. 1.

Protective layer 16 is preferably formed from a composite best seen in FIGS. 2 and 5, with outer layers 20 and 24 sandwiching an inner layer 22. The inner layer 22 of the composite is preferably formed from a flexible cellular polymeric material capable of cushioning the user's wrist. Outer layers 20 and 24 are preferably of elastic fabrics such as spandex or ANTRON polyester, that are applied to foam layer 22, for example, by a pressure sensitive adhesive which may be sprayed on, or rolled or brushed on. In the preferred embodiment, edging 26 is applied by stitching in order to protect the sides of the composite protective layer 16, thereby reducing the possibility of delamination thereof.

Figure 3:
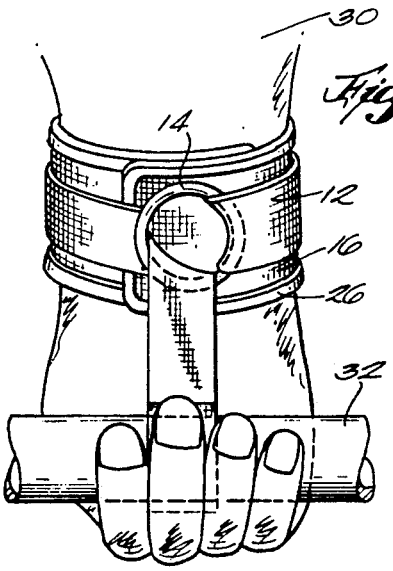
FIG. 3 is a view of the device shown in FIG. 1, in use on a wearer's forearm, with parts broken away, as viewed from the palm side of the hand.
Figure 4:
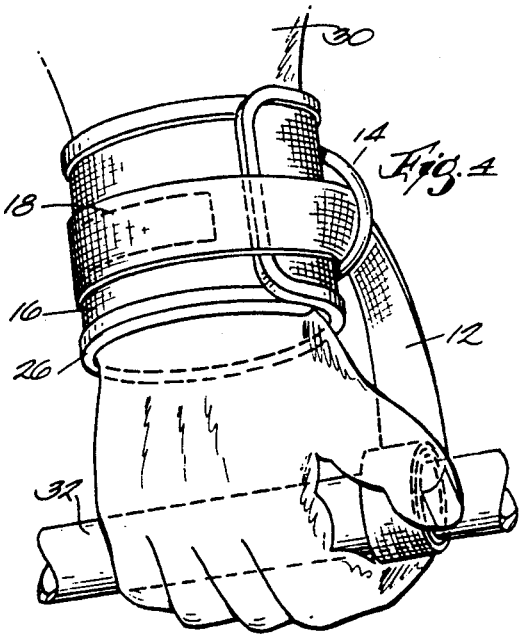
FIG. 4 is a perspective view of the device of FIG. 3 viewed from the back of the hand.

As seen in FIGS. 3 and 4, in use the device is wrapped around the wrist of the user so that the ends of protective layer 16 overlie each other with ring 14 facing outward. The free end of strap 12 is then inserted through ring 14, twisted 90°, and then wrapped around weight bar 32. It will be noted that the end of strap 12 will then lie flat against the palm of the user. Moderate pressure of the user's fingers on the portion of strap 12 encircling weight bar 32 holds the strap in place on the bar. When the user then lifts the bar 32 with weights in place on opposite ends thereof, the majority of the weight is supported by strap 12 and thus transferred to the user's wrist 30. The user is thus enabled to provide desired exercise to the muscles of his upper arms and torso while reducing the forces applied to his fingers.

As indicated above, the inner and outer layers 20 and 24 are preferably manufactured from a stretchable elastic fabric of the spandex type, preferably the type sold under the tradename LYCRA, or of certain polyester fabrics including the type sold by the Sports Fabrics Division of DuPont under the trademark ANTRON. Internal layer 22 can be formed from various tough, yieldable, flexible elastomeric foams. An example of a suitable foam material is a closed cell polyethylene foam commercially available under the trade name VOLARA. Various other flexible foam materials such as polyurethane foam or various other tough, flexible foams can be substituted. As noted, it is preferred to laminate the layers by means of adhesive such as an aerosol-sprayable, brushable or rollable pressure sensitive adhesive prior to stitching thereon of the edging materials and strap 12. The adhesive prevents delamination and creasing of the various layers of the cushioning or protective layer 16.

It will be appreciated by those skilled in the art that the foregoing detailed description is given for illustrative purposes and that various modifications falling within the spirit of the invention and scope of the appended claims can be made.

What is claimed is:

1. A support device adapted to encircle the wrist of a weightlifter and to be wrapped around a weight bar to assist in transferring to the weightlifter's wrist and forearm a weight being lifted, said support device comprising:

a flexible fabric strap, a substantially inflexible folding means in the form of a ring, having a diameter greater than the width of the strap, attached to one of said strap, a protective cushioning member for cushioning and protecting the wrist of the weightlifter formed from a core of flexible cellular, elastomeric, polymeric material surfaced on each side by an elastic fabric surface wherein said cushioning member is attached to the portion of the strap adjacent to said ring such that one end of said cushioning member underlies said end of said strap and is adjacent to and extends slightly beyond the edge of said ring, each end of said cushioning member and each end of said strap being detachable from each other, the end of said strap opposite said ring being elongated and extending beyond the other end of said cushioning member to provide an unencumbered free flexible fabric end for extension through said ring and wrapping around a weight bar to be lifted, said one end and said other end of said cushioning member are unencumbered and free to slide relative to each other when said support device is in an encircling position on the wrist of a weightlifter, whereby the weight of said weight bar causes tightening of said cushioning member about the wrist of the weightlifter.

2. A device according to claim 1 wherein said folding means and said protective cushioning member are attached to said strap by means of stitching.

3. A device according to claim 2 wherein said protective cushioning member is provided with an edging stitched around the perimeter thereof.

4. A device according to claim 1 wherein said cushioning member is of a length sufficient to encircle the weightlifter's wrist.

5. A device according to claim 4 wherein said cushioning member is stitched at its center to said strap and each end thereof is free of said strap.

6. A device according to claim 1 wherein said folding means comprises a rectangular ring.

7. A device according to claim 1 wherein said folding means comprises a triangular ring.

8. A device according to claim 1 wherein said folding means comprises a D-shaped ring.

9. A support device adapted to encircle the wrist of a weightlifter and to be wrapped around a weight bar to assist in transferring to the weightlifter's wrist and forearm a weight being lifted, said support device comprising:

a protective cushioning member for cushioning and protecting the wrist of the weightlifter including a core of flexible cellular, elastomeric, polymeric material surfaced on each side by an elastic fabric surface, and having two ends and a longitudinal axis, each end of said cushioning member being unencumbered and free to slide relative to each other when in an encircling position on the wrist of a weightlifter;

a flexible fabric strap attached to one side of said cushioning member, said strap being elongated and being oriented parallel to said longitudinal axis and extending beyond one end of said cushioning member to provide an unencumbered free flexible fabric end for wrapping around a weight bar to be lifted; and a substantially inflexible folding means in the form of a solid ring, attached to said cushioning means such that one end of said cushioning means underlies, is adjacent to and extends slightly beyond the edge of said ring, said ring being adapted to allow said strap to pass and fold therethrough, whereby a weight bar causes tightening of said cushioning member about the wrist of a weightlifter.

10. A device according to claim 9 wherein said folding means and said strap are attached to said protective cushioning member by means of stitching.

11. A device according to claim 10 wherein said protective cushioning member is provided with an edging stitched around the perimeter thereof.

12. A device according to claim 9 wherein said folding means is of a width greater than the width of said strap.

13. A device according to claim 12 wherein said cushioning member is of a length sufficient to encircle the weightlifter's wrist.

14. A device according to claim 13 wherein said strap and said cushioning member are stitched together between the ends of said cushioning member and each of said cushioning member is free of said strap.

15. A device according to claim 9 wherein said folding means comprises a rectangular ring.

16. A device according to claim 9 wherein said folding means comprises a triangular ring.

17. A device according to claim 9 wherein said folding means comprises a D-shaped ring.

* * * * *